US007131247B2

(12) United States Patent
Boriani et al.

(10) Patent No.: US 7,131,247 B2
(45) Date of Patent: Nov. 7, 2006

(54) METHOD AND DEVICE FOR FINISHING CELLOPHANE-WRAPPED PACKETS

(75) Inventors: Silvano Boriani, Bologna (IT); Stefano Negrini, Calderara di Reno (IT)

(73) Assignee: G.D Societa' per Azioni, Bologna (IT)

( * ) Notice: Subject to any disclaimer, the term of this patent is extended or adjusted under 35 U.S.C. 154(b) by 58 days.

(21) Appl. No.: 11/075,503

(22) Filed: Mar. 9, 2005

(65) Prior Publication Data

US 2005/0198928 A1 Sep. 15, 2005

(51) Int. Cl.
*B65B 53/02* (2006.01)

(52) U.S. Cl. ..... 53/442; 53/557; 198/483.1; 414/788.8

(58) Field of Classification Search ..... 53/442, 53/557, 387.4, 387.3, 377.8; 198/418.4, 198/483.1, 626.1, 626.2, 445, 447; 414/795.4, 414/796, 796.2, 788.8, 790.9, 791; *B65B 53/02*
See application file for complete search history.

(56) References Cited

U.S. PATENT DOCUMENTS 2,277,408 A * 3/1942 Desmond et al. ..... 53/73
5,311,723 A * 5/1994 Boriani et al. ..... 53/491
5,417,037 A * 5/1995 Osti et al. ..... 53/446
5,462,401 A 10/1995 Brizzi et al.
6,068,106 A * 5/2000 Brizzi et al. ..... 198/448
6,511,405 B1 1/2003 Focke et al.

FOREIGN PATENT DOCUMENTS

DE 38 24 924 1/1990
DE 4202883 A1 * 8/1993
EP 0 941 929 9/1999
EP 1103465 A1 * 5/2001

* cited by examiner

*Primary Examiner*—Stephen F. Gerrity
(74) *Attorney, Agent, or Firm*—Marshall, Gerstein & Borun LLP

(57) ABSTRACT

A method and device for finishing cellophane-wrapped packets, whereby a succession of stacks, each defined by two superimposed packets having respective heat-shrink overwrappings, are fed successively by a conveyor wheel along a circular track extending through an unloading station, prior to reaching which the packets in each stack are parted in an axial direction with respect to the conveyor wheel, and are then fed, in a radial direction with respect to the conveyor wheel, along respective superimposed paths separated by a heating plate.

20 Claims, 3 Drawing Sheets

METHOD AND DEVICE FOR FINISHING CELLOPHANE-WRAPPED PACKETS

This application claims priority to Italian Application No. BO2004A 000137 filed on Mar. 11, 2004 in the name of G. D SOCIETA' PER AZIONI.

The present invention relates to a method and device for finishing cellophane-wrapped packets having respective overwrappings of heat-shrink material.

Though suitable for finishing any type of packet having an overwrapping of heat-shrink material, the present invention may be used to advantage in the tobacco industry for finishing packets of cigarettes coming off a cellophaning machine, to which the following description refers purely by way of example.

BACKGROUND OF THE INVENTION

In the tobacco industry, cellophaning machines are used, which are capable of forming the packets into stacks, each defined by a first and a second packet, with the second packet superimposed on the first, and with a major lateral surface of the second packet contacting a corresponding major lateral surface of the first packet. The stacks of packets are normally fed successively in a given direction along a track extending in a plane parallel to said major lateral surfaces, and through an unloading station where the stacks are unloaded onto an unloading conveyor and fed to an input of a cartoning machine.

The packets coming off cellophaning machines are normally subjected to a finish operation, in which the packets are heated to heat-shrink the overwrappings. For this to be done properly, without wrinkling the overwrappings, both the major lateral surfaces of each cellophane-wrapped packet must be heated, which is relatively easy to do on cellophaning machines on which the packets are conveyed one by one. The same does not apply, however, on cellophaning machines of the type described above, on which the packets are conveyed stacked in pairs, on account of the mutually contacting major lateral surfaces of the packets in each stack not being accessible directly.

U.S. Pat. No. 6,511,405B1 discloses an apparatus for producing cigarette packs of the hinge-lid-box type; in order to improve the outer appearance of the cigarette packs, once an outer wrapper has been provided and sealed the cigarette packs are conveyed through a shrinking station and subjected to the action of heat in the region of the large-surface-area pack sides, in particular in the region of upwardly directed front sides. For this purpose, heating plates are positioned in the region of the shrinking station and transmit heat to the upwardly directed surfaces of the cigarette packs.

U.S. Pat. No. 5,462,401A1 discloses a method of separating two superimposed rows of cigarette packets originally in direct contact with each other, whereby the two superimposed rows are fed into the input station of a separating device in a first direction parallel to the longitudinal axis of the rows; and are fed in a second direction, perpendicular to the first direction, to a separating station where they are separated by raising the top row and subsequently inserting, between the separated rows, a separating plate which is maintained between the rows as these are removed from the separating station in a third direction parallel to the first.

SUMMARY OF THE INVENTION

It is an object of the present invention to provide a method and device of finishing cellophane-wrapped packets having respective overwrappings of heat-shrink material, which provides, in a straightforward, low-cost manner, for directly heating both the major lateral surfaces of each packet on cellophaning machines on which the packets are conveyed stacked in pairs.

According to the present invention, there is provided a method and a device of finishing cellophane-wrapped packets having respective overwrappings of heat-shrink material as recited in the attached claims.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Number 1 in FIGS. 1 to 4 indicates as a whole a device for finishing cellophane-wrapped packets 2 (FIGS. 2 to 4) having respective overwrappings 3 of heat-shrink material.

Figure 3:
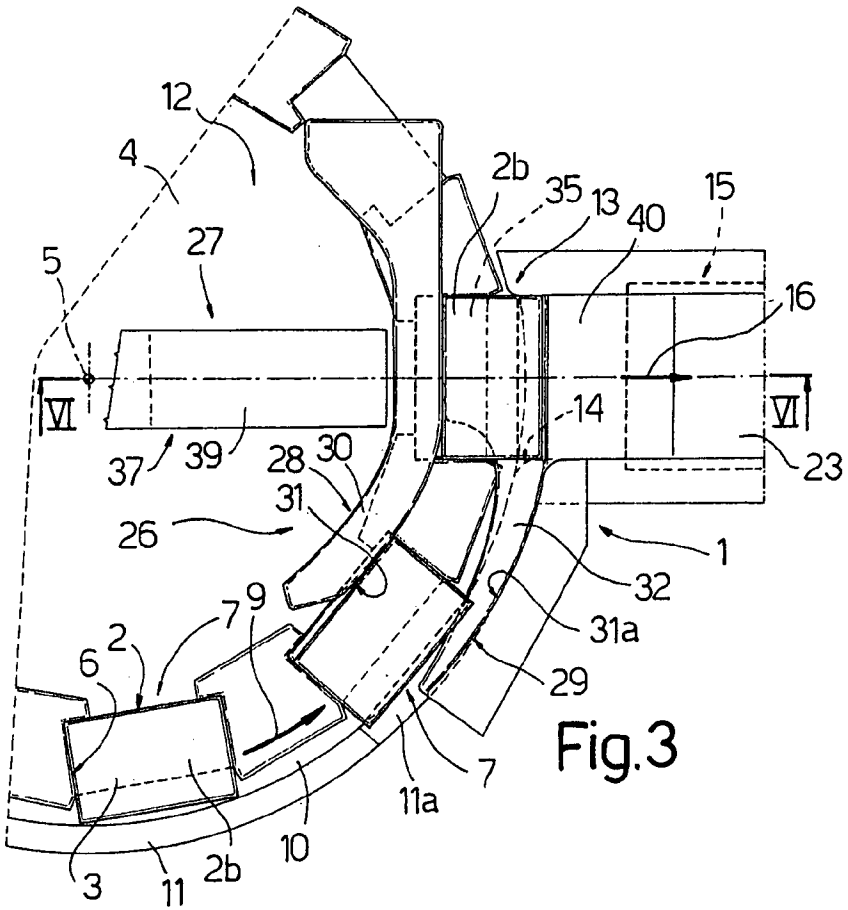
FIGS. 2, 3 and 4 are similar to FIG. 1, and show the FIG. 1 device in respective operating positions.
Figure 1:
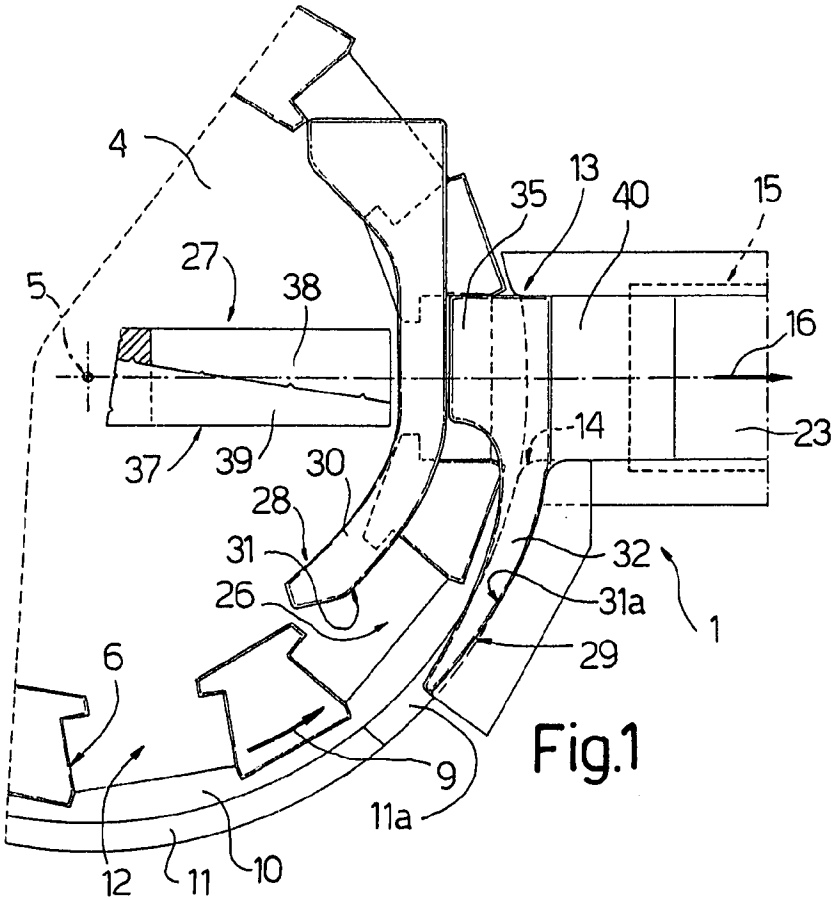
FIG. 1 shows a partial plan view of a preferred embodiment of the device according to the present invention.
Figure 2:
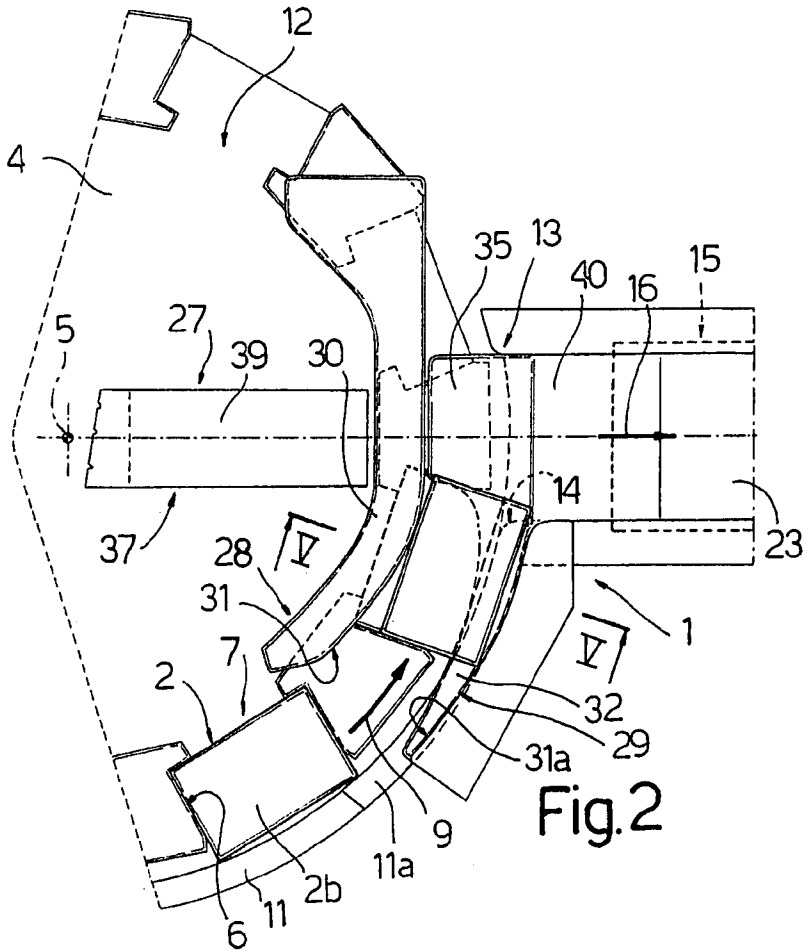
Figure 4:
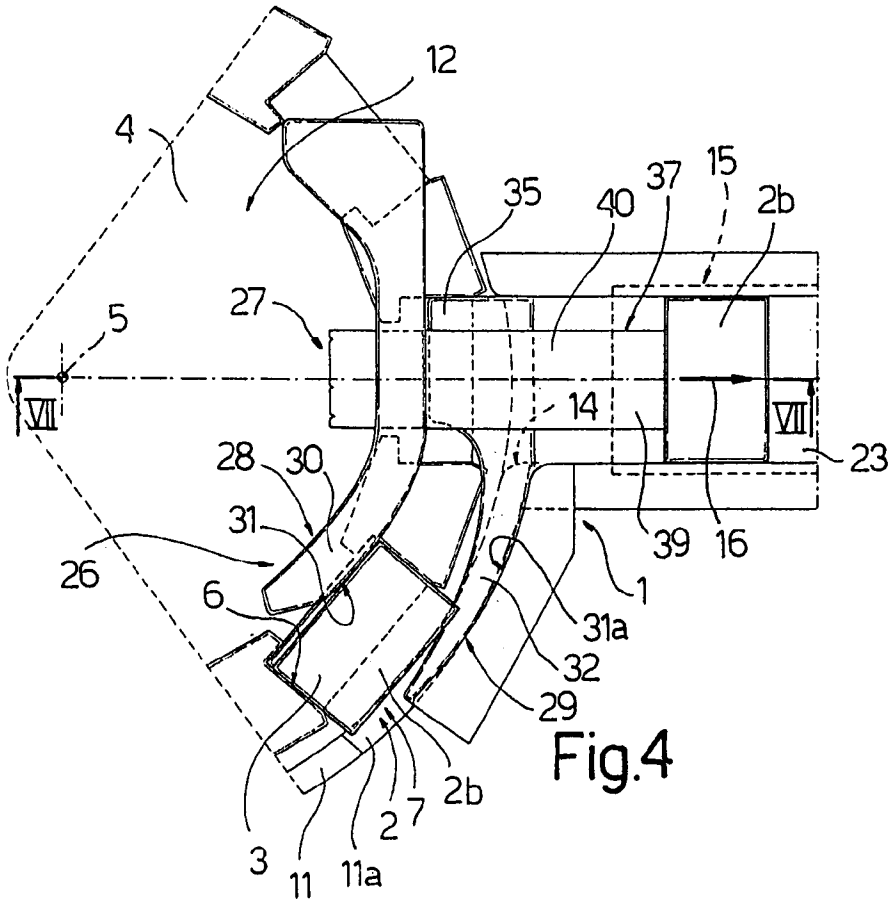
Figure 5:
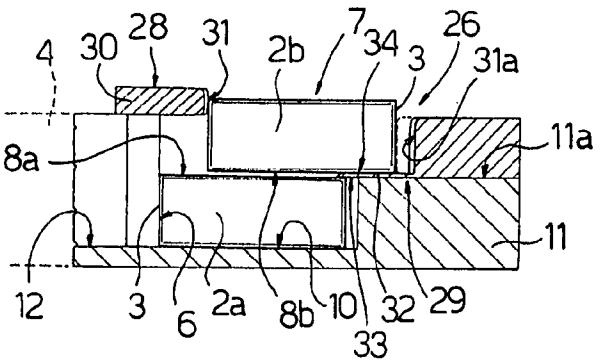
FIG. 5 shows a section along line V—V in FIG. 2.
Figure 6:
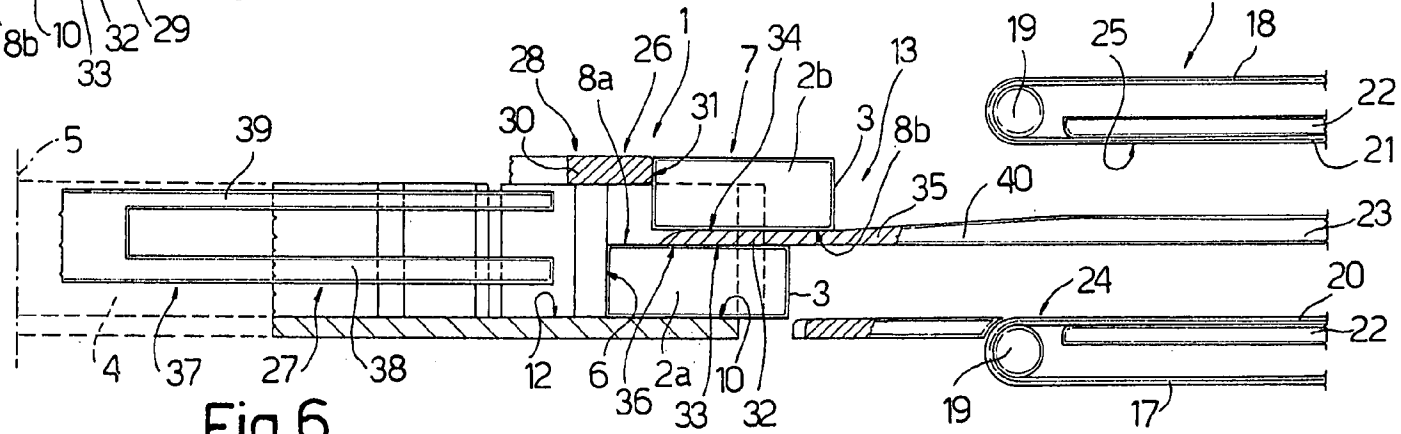
FIG. 6 shows a section along line VI—VI in FIG. 3.
Figure 7:
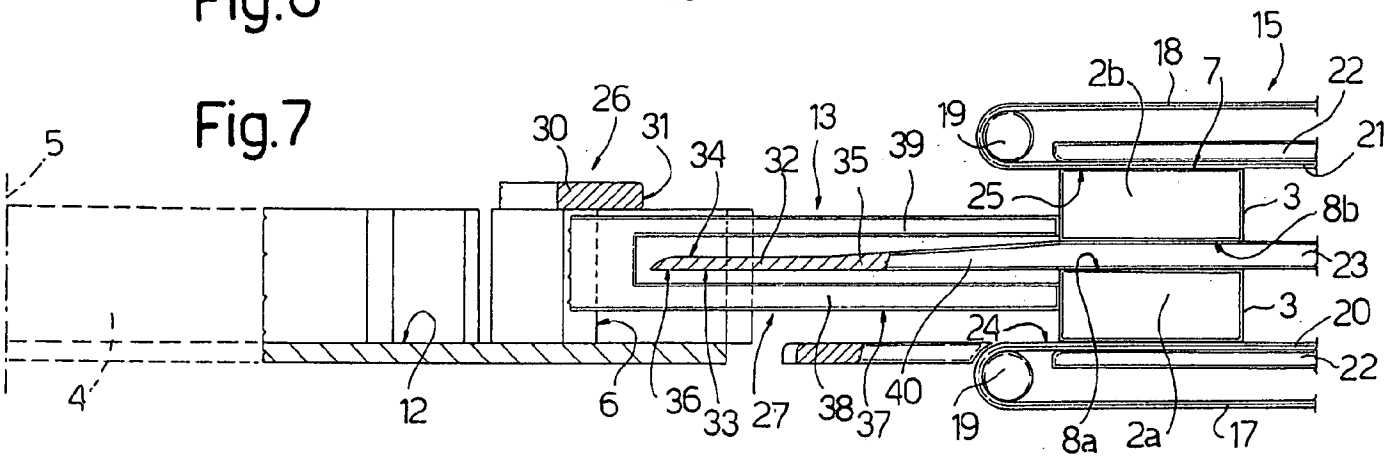
FIG. 7 shows a section along line VII—VII in FIG. 4.

Device 1 comprises a conveyor wheel 4 mounted to rotate in steps about a vertical axis 5, and comprising a number of peripheral pockets 6 equally spaced about axis 5 and for receiving respective stacks 7 (FIGS. 2 to 4), each defined, as shown more clearly in FIGS. 5 to 7, by a bottom packet 2*a* and a top packet 2*b* positioned contacting each other along respective major lateral surfaces 8*a*, 8*b* facing upwards and downwards respectively.

Conveyor wheel 4 rotates anticlockwise in FIGS. 1 to 4 to feed stacks 7 successively in a travelling direction 9 along a track 10 bounded externally by a cylindrical retaining wall 11, which is coaxial with axis 5, is located outwards of pockets 6, and extends upwards from a flat, horizontal surface 12 defining a bottom surface of conveyor wheel 4, defining the bottom of pockets 6, and supporting bottom packets 2*a* of stacks 7.

Track 10 extends through an unloading station 13, immediately upstream from which, cylindrical wall 11 comprises a lower portion 11*a*, the height of which above surface 12 is approximately equal to but no less than the thickness of a packet 2. At unloading station 13, lower portion 11*a* is broken by a radial opening 14 of a width at least equal to the length of a packet 2, and which connects track 10 to an unloading conveyor 15 which receives stacks 7 successively in an unloading direction 16 substantially parallel to surface 12, directed radially with respect to conveyor wheel 4, and crosswise to travelling direction 9 at unloading station 13.

As shown more clearly in FIGS. 6 and 7, unloading conveyor 15 comprises two endless belts 17 and 18 looped about respective horizontal pulleys 19 (only one of which is shown for each endless belt 17, 18) and having respective conveying branches 20 and 21, which are positioned facing one over the other, are fitted with respective heating elements 22, and are both moved in the same direction parallel to unloading direction 16. Conveying branch 20 is located beneath conveying branch 21, is substantially coplanar with track 10, and is separated from conveying branch 21 by a heating plate 23, which is parallel to track 10 and to conveying branches 20 and 21, is positioned symmetrically with respect to conveying branches 20 and 21, and defines, between conveying branches 20 and 21, two unloading paths or channels 24 and 25 of equal height and each of a height substantially equal to the thickness of a packet 2.

Device 1 also comprises a spacer assembly 26 for parting major lateral surfaces 8*a*, 8*b* of packets 2*a*, 2*b* of each stack 7 immediately upstream from unloading station 13; and a push device 27 movable back and forth in unloading direction 16 to feed each packet 2*a*, 2*b* of each stack 7 along respective unloading channel 24, 25 at unloading station 13.

Spacing assembly 26 comprises a lateral push member 28 for moving packet 2*b* of each stack 7 with respect to relative packet 2*a*, by applying thrust to packet 2*b* in a direction crosswise to travelling direction 9 and substantially parallel to surface 12, to move packet 2*b* outwards and away from axis 5, so that a portion of major lateral surface 8*b* of packet 2*b* projects laterally outwards of conveyor wheel 4 with respect to major lateral surface 8*a* of relative packet 2*a*. Spacing assembly 26 also comprises a bottom push member 29 for applying thrust to the projecting portion of major lateral surface 8*b* in a lift direction substantially perpendicular to surface 12 and parallel to axis 5.

Lateral push member 28 and bottom push member 29 are passive members located in fixed positions along track 10 and extending partly upstream from and partly through unloading station 13. More specifically, lateral push member 28 is defined by a plate 30, which is mounted facing track 10, is parallel to surface 12, is located on the opposite side of track 10 to unloading channels 24 and 25, and is separated from surface 12 by a distance greater than the thickness of a packet 2 and smaller than the height of a stack 7. On the side facing lower portion 11*a* of cylindrical wall 11, plate 30 comprises a curved cam profile 31, an inlet portion of which is separated from axis 5 by a distance equal to the distance between axis 5 and the back of each pocket 6, and an outlet portion of which, extending in front of lower portion 11*a* and through unloading station 13, is separated from axis 5 by a distance greater than the distance between axis 5 and the back of each pocket 6.

Immediately upstream from unloading station 13, bottom push member 29 comprises a wedge-shaped plate 32, which is sickle-shaped when viewed from above, is located over lower portion 11*a* of cylindrical wall 11, is substantially coplanar with heating plate 23, and projects partly over track 10. Plate 32 faces cam profile 31, and projects towards cam profile 31 from a block which is bounded, on the side facing track 10, by a curved surface 31*a* parallel to cam profile 31 and separated from cam profile 31 by a distance substantially equal to the width of track 10. Plate 32 is bounded at the bottom by a flat surface 33 facing and parallel to surface 12, and is bounded at the top by a sloping two-slope surface 34, so that plate 32 increases in thickness towards unloading station 13 in travelling direction 9, and decreases in thickness towards track 10 in unloading direction 16. From a width of substantially zero, plate 32 increases in width towards unloading station 13, and is connected at unloading station 13 to a flat plate 35, which forms part of bottom push member 29, extends substantially the whole width of track 10, and is bounded at the bottom by a flat surface coplanar with surface 33 and defining, with surface 12, a passage 36 engaged by packets 2*a*.

Push device 27 is located at unloading station 13, moves back and forth across track 10 in unloading direction 16, and comprises, on its free end, a fork 37, in turn comprising two arms 38 and 39 of the same length, located one over the other, and parallel to unloading direction 16. Arm 38 is located beneath arm 39 and plate 35 and above surface 12, and moves through passage 36 to engage a stationary packet 2*a* at unloading station 13 and push it in unloading direction 16 to the inlet of unloading channel 24; while arm 39 is located above plate 35, and engages a stationary packet 2*b* at unloading station 13 to push it in unloading direction 16 to the inlet of unloading channel 25.

To feed each packet 2*b* to the inlet of unloading channel 25 and onto heating plate 23, plate 35 is connected to heating plate 23 by an intermediate plate 40, the bottom surface of which is coplanar with the bottom surface of plate 35, and the top surface of which slopes upwards towards heating plate 23, which is thicker than plate 35.

Operation of device 1 will be described with reference to the accompanying drawings, with reference to one stack 7, and as of the instant (FIG. 2) in which stack 7 (the first bottom-left stack 7 in FIG. 2) reaches a position immediately upstream from spacing assembly 26.

As the stack 7 considered engages spacing assembly 26 (FIG. 5 and top stack 7 in FIG. 2), packet 2*b* laterally contacts cam profile 31, is moved gradually outwards with respect to conveyor wheel 4, and slides on top of relative packet 2*a* to project partly from relative pocket 6. As a consequence of this substantially radial movement with respect to conveyor wheel 4, a portion of major lateral surface 8*b* of packet 2*b* moves onto plate 32, and packet 2*b*, as it moves gradually towards unloading station 13, is raised with respect to relative packet 2*a* and eventually fed onto plate 35. During this movement, packet 2*a* continues along track 10, remains housed entirely inside relative pocket 6, and engages passage 36.

At unloading station 13 (FIG. 6 and top stack 7 in FIG. 3), packet 2*a* is located beneath plate 35 and still in its original position inside relative pocket 6, while packet 2*b* is located over plate 35 and partly extracted from relative pocket 6.

At this point, when push device 27, in the normal withdrawn position shown in FIG. 6, is activated (FIGS. 4 and 7), arm 38 first contacts packet 2*a* and moves packet 2*a* only in direction 16 into a position directly beneath relative packet 2*b*, after which, both packets 2*a* and 2*b* are moved simultaneously along relative unloading channels 24 and 25 into a final position (FIGS. 4 and 7) in which both packets 2*a* and 2*b* engage unloading conveyor 15 and are positioned with major lateral surfaces 8*a* and 8*b* directly contacting heating plate 23.

In other words, each packet 2*a*, 2*b* travels along unloading conveyor 15 with its two major lateral surfaces exposed to the heat produced by heating plate 23 and relative heating element 22 respectively, thus evenly shrinking relative overwrapping 3.

In connection with the above, it should be pointed out that this is achieved using a fully passive spacing assembly 26, i.e. comprising fixed, non-powered members, which involve practically no mechanical complications, and in no way affect the reliability of conveyor wheel 4.

The invention claimed is:

1. A method of finishing cellophane-wrapped packets (2) having respective overwrappings of heat-shrink material, the method comprising the steps of:

feeding a succession of stacks (7), each defined by a first and second packet (2*a*, 2*b*) with the second packet (2*b*) superimposed on the first (2*a*) and having a major lateral surface (8*b*) contacting a corresponding major lateral surface (8*a*) of the relative first packet (2*a*), in a given travelling direction (9) along a track (10) extending on a supporting surface (12) and through an unloading station (13);

parting the corresponding said major lateral surfaces (8*a*, 8*b*) of the packets (2*a*, 2*b*) in each said stack (7) upstream from said unloading station (13); and then feeding the packets (2*a*, 2*b*) in each stack (7), at the unloading station (13), in an unloading direction (16), crosswise to said travelling direction (9) and substantially parallel to said supporting surface (12), and along respective superimposed unloading paths (24, 25) separated by a heating plate (23);

the method is characterized in that the step of parting the corresponding said major lateral surfaces (8*a*, 8*b*) of the packets (2*a*, 2*b*) in each stack (7) comprises the substeps of:

moving the second packet (2*b*) in each stack (7) with respect to the first packet (2*a*), by applying to one of the relative two packets (2*a*, 2*b*) a first thrust crosswise to said travelling direction (9) and substantially parallel to said supporting surface (12), so that a portion of said major lateral surface (8*b*) of the second packet (2*b*) projects laterally with respect to the corresponding major lateral surface (8*a*) of the relative first packet (2*a*); and applying to said projecting portion a second thrust in a lift direction substantially perpendicular to said supporting surface (12).

2. A method as claimed in claim 1, wherein the corresponding said major lateral surfaces (8*a*, 8*b*) of the packets (2*a*, 2*b*) in each stack (7) are parted by engaging the stack (7) by means of passive spacing means (26) located along the track (10) and extending at least partly upstream from the unloading station (13).

3. A method as claimed in claim 1, wherein the first thrust is applied by engaging the second packet (2*b*) by means of a fixed first push member (28) having a cam profile (31) extending along the track (10) partly upstream from and partly through the unloading station (13); the first packet (2*a*) being fed, along the track (10) and through the unloading station (13), between said supporting surface (12) and the first push member (28).

4. A method as claimed in claim 3, wherein the first thrust is directed, at said unloading station (13), parallel to the unloading direction (16).

5. A method as claimed in claim 1, wherein the second thrust is applied by engaging said projecting portion by means of a fixed second push member (29) comprising a wedge-shaped plate (32) located outwards of the track (10); the second push member (29) extending along the track (10) partly upstream from and partly through the unloading station (13); and the first packet (2*a*) being fed, along the track (10) and through the unloading station (13), between said supporting surface (12) and the second push member (29).

6. A method as claimed in claim 5, wherein the second push member (29) is substantially coplanar with the heating plate (23).

7. A method as claimed in claim 5, wherein the wedge-shaped plate (32) is bounded on one side by a flat surface (33) facing and parallel to said supporting surface (12), and on the other side by a sloping two-slope surface (34), so that the wedge-shaped plate (32) increases in thickness towards the unloading station (13) in the travelling direction (9), and decreases in thickness towards the track (10) in the unloading direction (16).

8. A method as claimed in claim 5, wherein the wedge-shaped plate (32) increases in width towards the unloading station (13).

9. A method as claimed in claim 5, wherein the step of feeding the packets (2*a*, 2*b*) in each stack (7) in the unloading direction (16) at the unloading station (13) is performed by means of a push device (27) located at the unloading station (13) and movable back and forth across the track (10) in the unloading direction (16); the push device (27) being designed to engage both packets (2*a*, 2*b*) in each stack (7) located at the unloading station (13).

10. A method as claimed in claim 9, wherein the push device (27) is a fork-shaped push device (27) having two arms (38, 39) located one over the other, parallel to the unloading direction (16), and located on opposite sides of the second push member (29).

11. A device for finishing packets (2) having respective overwrappings of heat-shrink material, the device comprising:

a track (10) for feeding a succession of stacks (7) of packets (2) in a given travelling direction (9), each stack (7) being defined by a first and a second said packet (2*a*, 2*b*), with the second packet (2*b*) superimposed on the first (2*a*) and having a major lateral surface (8*b*) contacting a corresponding major lateral surface (8*a*) of the relative first packet (2*a*), and the track (10) extending on a supporting surface (12);

an unloading station (13) for unloading the stacks (7), the unloading station (13) being located along the track (10);

conveying means (4) for feeding said succession of stacks (7) in the travelling direction (9) along the track (10) to the unloading station (13);

two superimposed unloading paths (24, 25) extending from the unloading station (13) in an unloading direction (16) crosswise to the travelling direction (9) and substantially parallel to said supporting surface (12);

a heating plate (23) interposed between the two unloading paths (24, 25);

spacing means (26) for parting the corresponding said major lateral surfaces (8*a*, 8*b*) of the packets (2*a*, 2*b*) in each stack (7) upstream from the unloading station (13); and unloading means (27) which, at the unloading station (13), feed each packet (2*a*, 2*b*) in each stack (7) in the unloading direction (16) and along a respective said unloading path (24, 25);

the device is characterized in that the spacing means (26) comprise a first push member (28) for moving the second packet (2*b*) in each stack (7) with respect to the first packet (2*a*), by applying to one of the two packets (2*a*, 2*b*) a first thrust crosswise to the travelling direction (9) and substantially parallel to said supporting surface (12), so that a portion of said major lateral surface (8*b*) of the second packet (2*b*) projects laterally with respect to the corresponding said major lateral surface (8*a*) of the first packet; and a second push member (29) for applying to said projecting portion a second thrust in a lift direction substantially perpendicular to said supporting surface (12).

12. A device as claimed in claim 11, wherein the spacing means (26) are passive fixed spacing means (26) located along the track (10) and extending at least partly upstream from the unloading station (13).

13. A device as claimed in claim 11, wherein the first push member (28) is a fixed push member having a cam profile (31) extending along the track (10) partly upstream from and partly through the unloading station (13).

14. A device as claimed in claim 13, wherein the cam profile (31) faces the track (10), is parallel to said supporting surface (12), and is located a given distance from the supporting surface (12) and on the opposite side of the track (10) to the unloading paths (24, 25).

15. A device as claimed in claim 11, wherein said second push member (29) is a fixed push member comprising a wedge-shaped plate (32) located outwards of the track (10); the second push member (29) extending along the track (10) partly upstream from and partly through the unloading station (13), being parallel to said supporting surface (12), and being located on the same side of the track (10) as the unloading paths (24, 25) and between the first push member (28) and the track (10).

16. A device as claimed in claim 15, wherein the second push member (29) is substantially coplanar with the heating plate (23).

17. A device as claimed in claim 15, wherein the wedge-shaped plate (32) is bounded on one side by a flat surface (33) facing and parallel to said supporting surface (12), and on the other side by a sloping two-slope surface (34), so that the wedge-shaped plate (32) increases in thickness towards the unloading station (13) in the travelling direction (9), and decreases in thickness towards the track (10) in the unloading direction (16).

18. A device as claimed in claim 15, wherein the wedge-shaped plate (32) increases in width towards the unloading station (13).

19. A device as claimed in claim 11, wherein the unloading means (27) comprise a push device (27) located at the unloading station (13) and movable back and forth across the track (10) in the unloading direction (16); the push device (27) being designed to engage both packets (2*a*, 2*b*) in each stack (7) located at the unloading station (13).

20. A device as claimed in claims 19, wherein the push device (27) is a fork-shaped push device (27) having two arms (38, 39) located one over the other, parallel to the unloading direction (16), and located on opposite sides of the second push member (29).

* * * * *

UNITED STATES PATENT AND TRADEMARK OFFICE

CERTIFICATE OF CORRECTION

PATENT NO. : 7,131,247 B2
APPLICATION NO. : 11/075503
DATED : November 7, 2006
INVENTOR(S) : Silvano Boriani et al.

It is certified that error appears in the above-identified patent and that said Letters Patent is hereby corrected as shown below:

On the Title Page:
Insert Item (30), For. Appl. Priority Data, -- March 11, 2004, (IT), BO2004A 000137 --.

Signed and Sealed this

Thirteenth Day of March, 2007

JON W. DUDAS
*Director of the United States Patent and Trademark Office*